US005711600A

United States Patent [19]

Toukonummi

[11] Patent Number: 5,711,600

[45] Date of Patent: Jan. 27, 1998

[54] HIGH CONSISTENCY PULP TOWER WITH A PARTING MEMBER AND THE INTRODUCTION OF DILUTION LIQUID

[75] Inventor: Olavi Toukonummi, Hajala, Finland

[73] Assignee: Ahlstrom Machinery Corporation, Noormarkku, Finland

[21] Appl. No.: 475,997

[22] Filed: Jun. 7, 1995

[30] Foreign Application Priority Data

Jun. 9, 1994 [FI] Finland ..... 942709

[51] Int. Cl.[6] ..... B01F 5/04; D21C 7/08

[52] U.S. Cl. ..... 366/171.1; 366/172.2; 366/341; 366/608; 162/17; 162/246

[58] Field of Search ..... 366/9, 101, 341, 366/348, 608, 171.1, 172.1, 172.2; 162/17, 18, 243, 246; 222/547, 564

[56] References Cited

U.S. PATENT DOCUMENTS

| | | | |
|---|---|---|---|
| 2,745,274 | 5/1956 | Rich | 162/246 X |
| 3,041,233 | 6/1962 | Richter | 162/18 |
| 3,519,532 | 7/1970 | Sutherland | 162/246 X |
| 3,554,864 | 1/1971 | Richter | 162/246 X |
| 3,787,284 | 1/1974 | Richter | 162/243 X |
| 3,804,304 | 4/1974 | Richter . | |
| 3,964,962 | 6/1976 | Carlsmith . | |
| 4,022,654 | 5/1977 | Engstrom et al. . | |
| 4,746,400 | 5/1988 | Sherman etal. | 162/17 |
| 4,867,845 | 9/1989 | Elmore | 162/243 |

FOREIGN PATENT DOCUMENTS

| | | | |
|---|---|---|---|
| 0269124 | 6/1988 | European Pat. Off. . | |
| 1488607 | 7/1967 | France . | |
| 897948 | 11/1953 | Germany | 162/17 |
| 84870 | 11/1935 | Sweden | 162/17 |

*Primary Examiner*—Charles E. Cooley
*Attorney, Agent, or Firm*—Nixon & Vanderhyd P.C.

[57] ABSTRACT

Cellulose pulp is discharged from the dilution zone of a high consistency pulp tower at a substantially even volume flow and a substantially steady pulp consistency by mounting a particular parting member within a bottom portion of the tower. The parting member is constructed so as to define a first cross-sectional area between it and the tower side wall which is smaller than a second cross-sectional area below the parting member, in the dilution zone. The parting member may comprise a cone, cone frustum, pyramid, or pyramid frustum mounted substantially concentrically with the tower axis. The first cross-sectional area is at most 95% of a second cross-sectional flow area in the dilution zone, and typically about 90% or less. A ring may extend inwardly from the side wall at the parting member and define the first cross-sectional flow area with the parting member. Alternatively the parting member may itself comprise a ring having a substantially triangular (e.g. equilateral triangle) cross-section with an upwardly pointing apex, the ring spaced from the side wall and substantially concentric with the tower axis. Pulp is diluted from a consistency over 20% to a consistency of about 3–15% in the dilution zone and discharged from the dilution zone. Two to six mixers may be provided in the dilution zone to facilitate pulp flow through the first cross-sectional area to the dilution zone, to effectively dilute the pulp in the dilution zone, and to discharge the diluted pulp through an outlet.

34 Claims, 8 Drawing Sheets

HIGH CONSISTENCY PULP TOWER WITH A PARTING MEMBER AND THE INTRODUCTION OF DILUTION LIQUID

BACKGROUND AND SUMMARY OF THE INVENTION

The present invention relates to high consistency pulp towers, and especially to improvements in discharging pulp therefrom. These towers are used in the wood processing industry, e.g., for peroxide bleaching and storage of high consistency pulp.

According to prior art, pulp has to be discharged in a diluted form from high consistency pulp towers. This is because high consistency pulp cannot be pumped with, for example, a centrifugal pump which, however, in recent arrangements is practically the only way of conveying pulp from one process stage to the other. Therefore, high consistency pulp (having most commonly a consistency of 20 to 35%) is diluted to at least a medium consistency (of about 10 to 15%) in the bottom portion of the pulp tower. This makes the pulp pumpable with a so-called fliuidizing centrifugal pump. Preferably, pulp is diluted to a consistency of about 3 to 5%, whereby it will be pumpable with a conventional centrifugal pump. Dilution is effected by introducing either clean water or filtrate from some suitable process stage into the bottom portion of the tower and mixing it with the pulp by mixers arranged for that purpose in the bottom portion, i.e., a so-called dilution zone of the tower.

Depending on whether high consistency pulp towers are used for either bleaching or storage, the constructions and appearances of their bottom portions are much different from each other for a number of reasons. Specific to all types of towers is, however, that even dilution is almost unattainable. The reason for this is that high consistency pulp as well as medium consistency pulp flows downwards in the tower unevenly. This again is caused by friction between the pulp and the tower wall, which retards the pulp flow so much that in between the zone of diluted pulp in the bottom portion and the undiluted pulp in the upper part of the tower, there will be formed an arch, which, after having expanded enough, will collapse down to the bottom portion of the tower. Since dilution liquid is introduced as an even flow into the tower, the pulp to be discharged from the tower is continuously diluted during arching and, immediately after the arch has collapsed, the consistency will increase to a maximum, whereby the required pulp consistency will remain somewhere between the maximum and minimum values. In one high consistency pulp tower the discharge consistency has been established to range from 3.2 to 6.1% (FIG. 1*a*). As the pulp is in most cases conveyed from the high consistency pulp tower to some other process stage, whereby chemicals are mixed with it in pumping or soon thereafter, it is easy to understand that the chemicals dosage per pulp unit cannot be even when the consistency ranges so drastically. Another problem resulting from the collapse of high consistency pulp down to the bottom portion of the tower may also be difficult, namely because it is quite possible that the mixer may be o damaged by the great volume of pulp falling onto it. In the worst case, the entire process has to be stopped for the repairs of the mixer.

For example, FI patents 58522 and 64821 disclose means which aim to adjust the feed of high consistency pulp to the dilution zone so as to make the pulp flow evenly, whereby the discharge of pulp from the dilution zone would also be effected in a steady consistency. The means comprise a rotative intermediate floor arranged in the pulp tower and preferably provided with blades for feeding pulp through a slot between the tower wall and the intermediate floor down to the dilution zone. However, said means so involve several drawbacks. Firstly, the intermediate floor has to be of a very sturdy construction because it carries practically all the weight of the pulp inside the tower. Secondly, the shaft of the intermediate floor and the bracing of the shaft have to be also very strong, not to mention the axial bearings of the shaft. Thirdly, the rotative intermediate floor is susceptible to damage, for example because, irrespective of all preventive measures, pulp may arch above the intermediate floor in the tower. Collapsing, in the worst case one-sided collapsing of such arched pulp, causes a heavy impact on the intermediate floor as well as on the bearings and the shaft, which easily breaks the bearing system or bends the shaft and/or the intermediate floor. Fourthly, the bearing system and the rotative mechanism calls for space below the tower. So, the tower has to be located relatively high up. This in turn results in that the bearings of the upper end of the shaft for the intermediate floor, which bearings for practical reasons are right below the intermediate floor, must be applied high up in the tower wall and be supported by the wall. Thus, the tower wall has to be particularly sturdy from the base to a very high level. Because of these numerous drawbacks of the rotative intermediate floor, this arrangement is not in use at pulp mills today.

Another way of arranging even downwards flow of pulp is described below. In the smallest towers having a diameter of about 3.5 to 7.0 m, the bottom portion may be either straight cylindrical or first somewhat narrowing and below that cylindrical. In bigger towers having a diameter typically larger than 5.0 m, a so-called bottom pillar is disposed at the center of the tower bottom. The purpose of the bottom pillar is to uphold pulp above the bottom portion and to divide the bottom portion into an annular mixing zone. Thus, for example, the maximum diameter of collapsing pulps may only be as long as the tower radius, whereas in the towers with no so bottom pillar, it may equal the tower diameter. The shape of the prior art bottom pillars may be either an evenly converging cone (FIG. 2*a*), cylindrical pillar (FIG. 2*b*) or, according to the state of the art, a cylindrical pillar the upper end whereof is arranged with an upwardly converging cone (FIG. 2*c*). In all those towers which are provided with a bottom pillar, the dilution mixer/dilution mixers are disposed on sides of the bottom pillar so that they direct the flow to circulate along the annular mixing zone. The bottom pillars are of solid construction and when disposed on the tower bottom they are merely supported by the tower bottom or the foundation therebelow, in any case by the very point which would also otherwise carry the weight of the pulp in the tower.

However, it has been shown in practice that conical or cylindrical bottom pillars alone, or combinations thereof, do not eliminate the unevenness of the pulp discharge consistency. As shown in FIG. 1*a*, the discharge consistency fluctuates from 3.2 to 6.1% when a bottom pillar according to FIG. 2*c* is used. Correspondingly, also the volume flow of the pulp being discharged fluctuates from 210 to 240 $m^3/h$ because the centrifugal pump is not at all insensitive to remarkable changes in the consistency.

FIG. 1*b* shows the test results received with a bottom pillar according to the invention, which bottom pillar is illustrated in FIG. 3. In that test, all other variables were the same as those with the test the results of which are shown in FIG. 1*a*, except for the construction of the bottom pillar. The results of FIG. 1*b* indicate that when a bottom pillar according to the invention is used, the volume flow and the consistency of the pulp to be discharged do not practically change at all.

According to one aspect of the present invention a high consistency pulp tower is provided comprising the following components: A tower having a side wall, bottom, generally vertical axis, and bottom portion above the bottom. Means for diluting high consistency pulp in the bottom portion, defining a dilution zone. Pulp discharge means from the dilution zone. And, a parting member disposed in the bottom portion above the diluting means and pulp discharge means, the parting member constructed so as to define a first cross-sectional flow area between the parting member and the side wall which is smaller than a second cross-sectional flow area below the parting member, in the dilution zone.

Typically the parting member is disposed substantially concentrically with the tower axis, supported by a pillar (one or more) extending from the tower bottom and/or a plurality of arms extending from the tower sidewall. The parting member is preferably a cone, cone frustum, pyramid, or pyramid frustum, extending upwardly from its base, and the area of the base substantially perpendicular to the axis of the tower is between 2.5–3.2 times (e.g. about 2.8 times) the cross-sectional area of the lower end of the pillar. Regardless of mechanism of support of the parting member, the first cross-sectional flow area is at most 95% of the second cross-sectional flow area (e.g. about 50–95% of the second cross-sectional flow area at the lower end of the pillar when a pillar is provided). The parting member, particularly when a cone, has an angle to the tower axis of between about 20°–45°, preferably about 30°.

Alternatively the parting member may comprise a ring having a substantially triangular (e.g. equilateral triangle) cross-section with an upwardly pointing apex, the ring spaced from the side wall and substantially concentric with the tower axis. Alternatively a ring may be provided mounted on the side wall and extending inwardly from the side wall toward the parting member and defining the first cross-sectional area with the parting member, the ring in this case typically also having a triangular cross-section (e.g. a right triangle).

The diluting means and the pulp discharge means may comprise any suitable structures. For example the diluting means may comprise dilution liquid nozzles, conduits, headers, valves, or like fluid introducing structures. The diluting means may further comprise mixers which facilitate the dilution by mixing dilution liquid with the pulp, and/or actually introduce dilution liquid at the same time that they generate turbulence in the pulp. The pulp discharge means may comprise a wide variety of conduits, outlets, pumps, or withdrawal devices, and the mixers may assist in the pulp discharge by establishing turbulence in the dilution zone and causing the flow of pulp toward an outlet mechanism.

According to another aspect of the invention a pulp tower is provided comprising: A tower having a side wall, bottom, generally vertical axis, and bottom portion above the bottom. And, a parting member disposed in the bottom portion substantially concentric with the tower axis, the parting member comprising a cone, cone frustum, pyramid, or pyramid frustum, extending upwardly from its base constructed so as to define a first cross-sectional flow area between the parting member base and the side wall which is at most 95% of a second cross-sectional flow area below the parting member base.

The invention also relates to a method of diluting and discharging cellulose pulp having a consistency of over 20% (e.g. about 20–35%) from a tower as described above. The method comprises the steps of: (a) Defining a first cross-sectional area in the bottom portion above the dilution zone which is at most 95% of a second cross-sectional flow area in the dilution zone. (b) Causing cellulose pulp having a consistency of over 20% to flow through the first cross-sectional area to the dilution zone. (c) Diluting the cellulose pulp in the dilution zone so that it has a consistency of about 15% or less (about 10–15%). And, (d) discharging the diluted cellulose pulp from the dilution zone of the tower at a substantially even volume flow and a substantially steady pulp consistency. Steps (b) through (d) may be practiced, at least in part, by disposing between 2–6 mixers in the dilution zone and introducing dilution liquid immediately adjacent at least one of the mixers.

It is the primary object of the present invention to provide even volume flow and steady consistency discharge of cellulose pulp from a tower. This and other objects of the invention will become clear from an inspection of the detailed description of the invention and from the appended claims.

DETAILED DESCRIPTION OF THE DRAWINGS

Figure 2A:
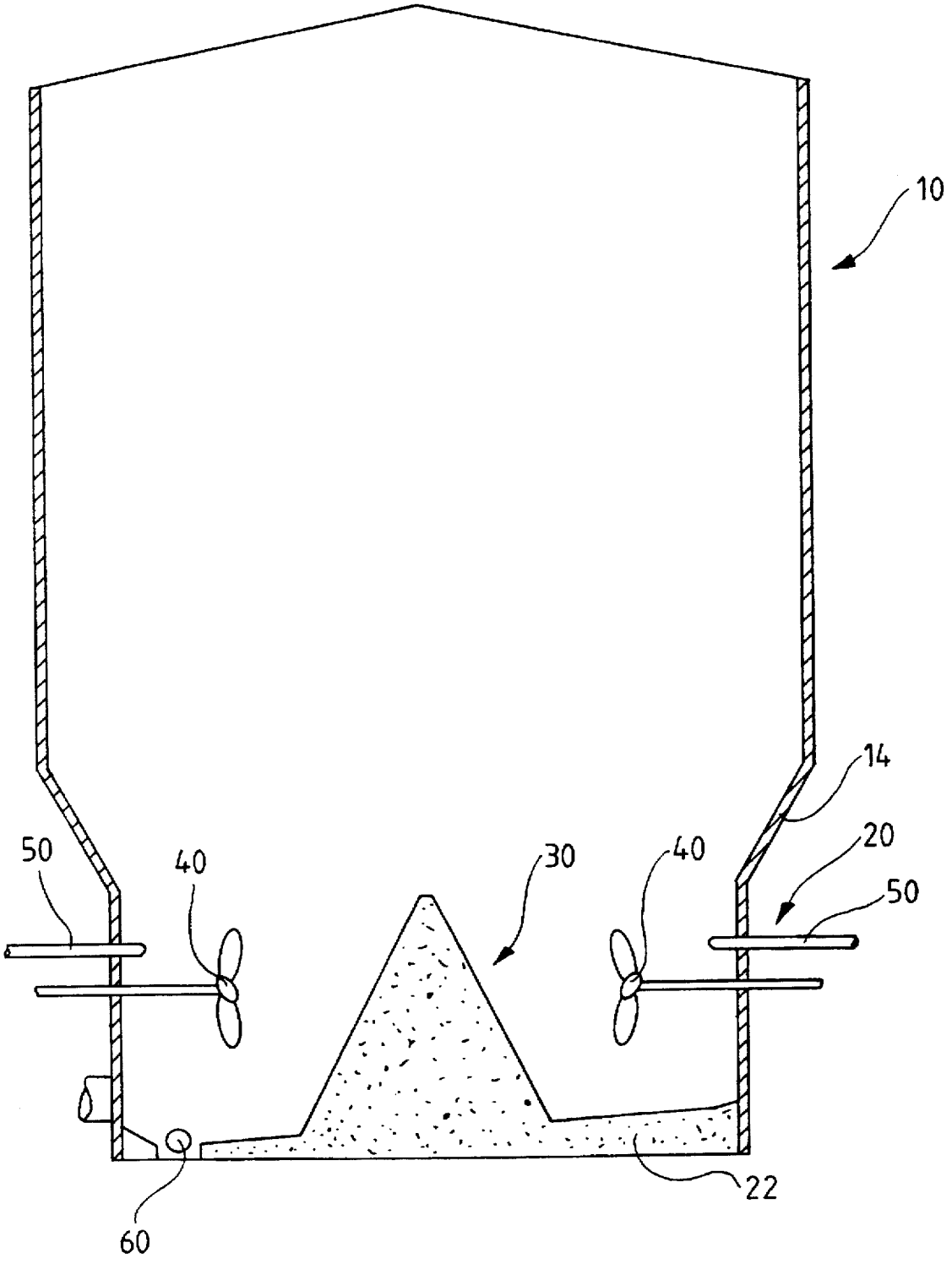
FIG. 2a Prior art
FIGS. 2*a*, 2*b*, and 2C illustrate bottom portions of prior art high consistency pulp towers.
Figure 2B:
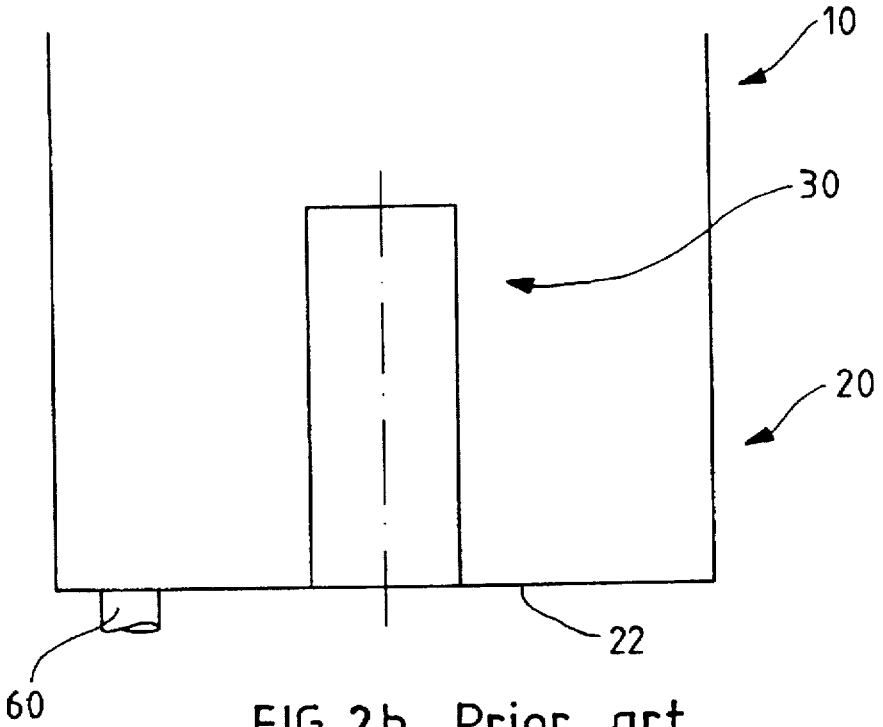
FIG. 2b Prior art
Figure 2C:
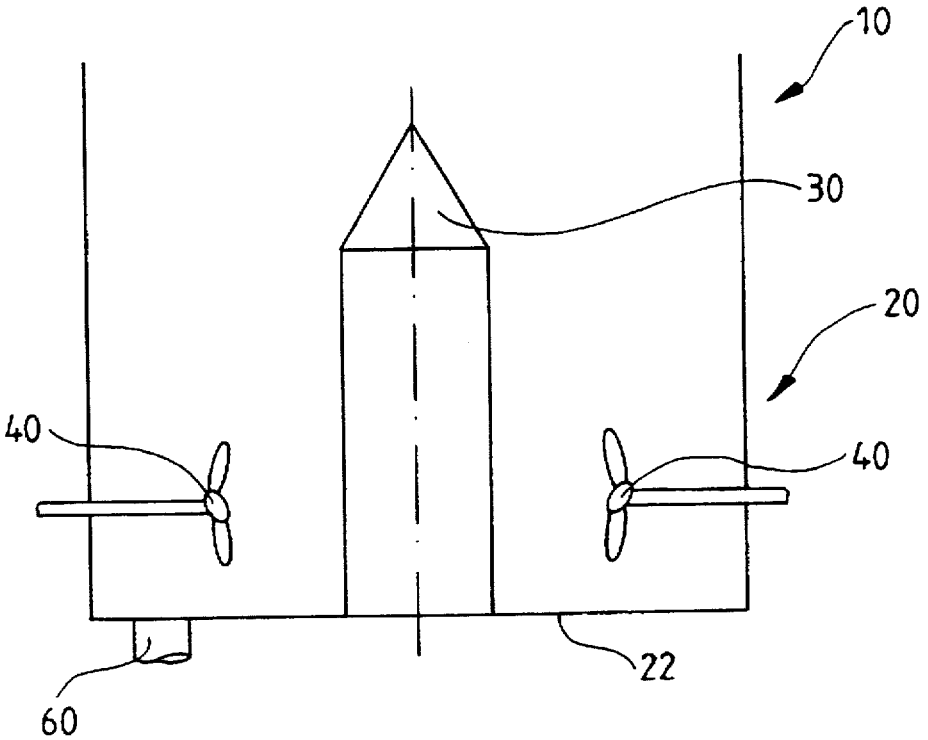
FIG. 2c Prior art

The following reference numerals are used in FIGS. 2*a* to 2*c* as well as through the whole description to denote the main components of a high consistency pulp tower: high consistency pulp tower 10, tower wall 12, bottom portion 20, tower bottom 22, bottom pillar 30, mixer/mixers 40, conduit/conduits 50 for feeding dilution liquid, and discharge means 60 for diluted pulp. The high consistency pulp tower 10 illustrated in FIGS. 2a–2c is used for, e.g., peroxide bleaching of pulp at high (e.g. 20 to 30%) consistency. In our example (shown in FIG. 2a), the diameter of tower 10 is about 5.5 m in the upper part of the tower and the total height is about 7.5 m. The height of bottom pillar 30 from bottom is about 1.8 m and the diameter of its lower part is 2 m. In the arrangement of FIG. 2a, bottom portion 20 and the upper part of tower 10, have a conical wall section 14 between them. However, it is not necessary for the operation of the tower. Mixers 40 are arranged at about 1.1 m height from the tower bottom and so that the dilution liquid is fed through conduits 50 to the dilution zone of the bottom portion, to a level which is a little higher than the mixer shafts.

The tower of FIG. 2b is either cylindrical or it widens slightly downwards. The purpose of the widening is to ensure that pulp flows evenly downwards in tower 10. Bottom pillar 30 of FIG. 2b is cylindrical and its upper end is flat. In FIG. 2c, bottom pillar 30 is cylindrical, but it is provided with a conical upper end.

Figure 3:
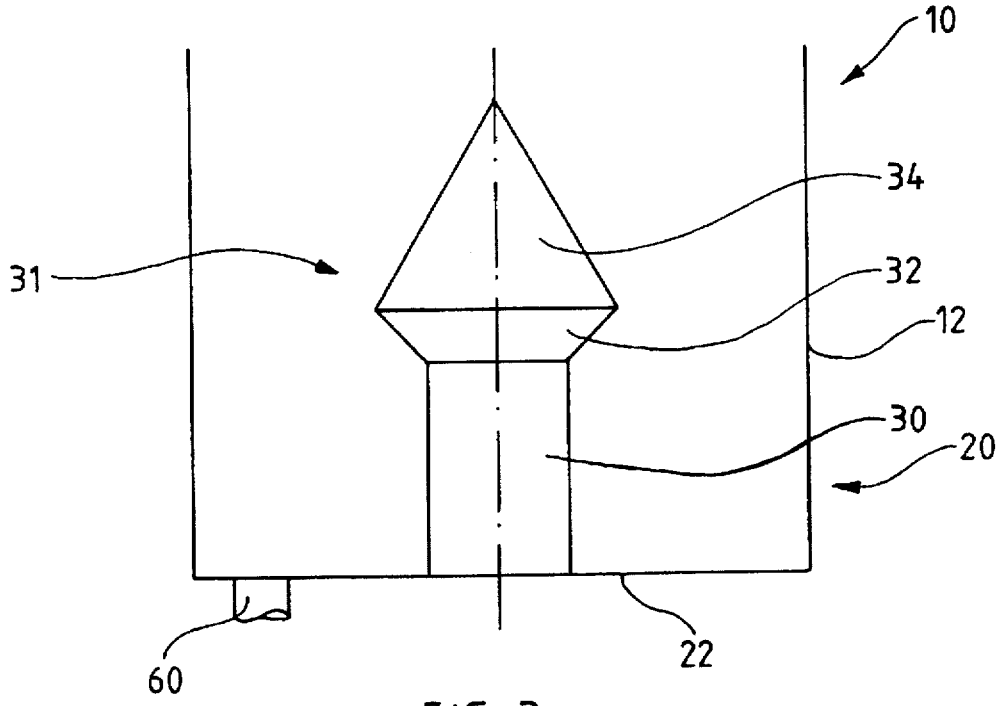
FIG. 3 illustrates the bottom portion of a high consistency pulp tower according to a preferred embodiment of the invention.

FIG. 3 shows an improved high consistency pulp tower 10 in accordance with the invention, bottom portion 20 thereof being provided with a bottom pillar 30, which is preferably cylindrical, although other cross-sectional shapes are also applicable. The upper end of pillar 30 has, however, been reshaped in comparison with prior art constructions. It is essential to the upper end of pillar 30 of this embodiment that the diameter of a parting member 31 disposed therein is at least in one point larger than the diameter of the lower part of pillar 30. More extensively, it is a characterizing feature of the invention that in the area of parting member 31, the cross section between parting member 31 and wall 12 of tower 10 is smaller than in the bottom area of the pillar 30. In the embodiment of FIG. 3, parting member 31 is formed of a first section 32, the diameter of which widens conically upwards, and a second section 34, the diameter of which converges conically upwards. In other words, at the point of contact between said first and second sections the diameter of the parting member is at its largest, whereby a throttle is formed between parting member 31 and tower wall 12. The purpose of this throttle is to even the downwards flow of high consistency pulp.

While the term "conical" as used above, it should be understood that the parting member may be a cone, cone frustum, pyramid (of any shape base, such as square, pentagonal, or hexagonal), or pyramid frustum, extending upwardly from its base. As seen in FIG. 3 the parting member may comprise a cone 34 and cone frustum 32 having a base in common, with the cone 34 extending upwardly and the frustum 32 extending downwardly to the pillar 30.

Figure 4:
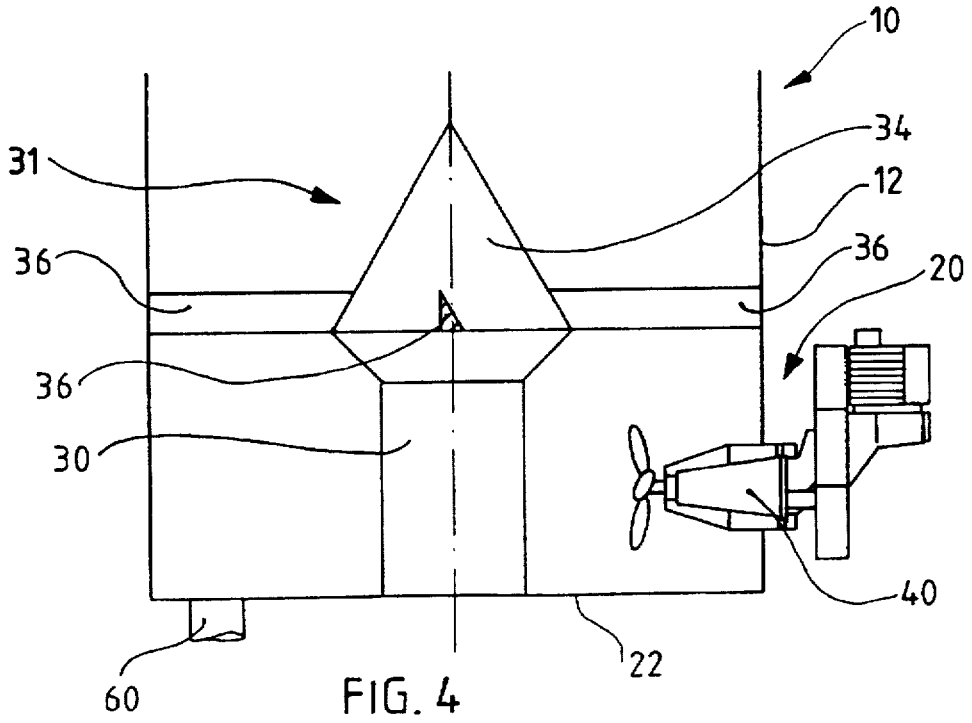
FIG. 4 illustrates the bottom portion of a high consistency pulp tower according to a second preferred embodiment of the invention.

FIG. 4 shows a bottom pillar in accordance with FIG. 3 except that the second conical surface 34 of parting member 31 is provided with preferably radial fillets or arms 36, one end of each fillet 36 being attached to wall 12 of tower 10. It can also been seen from FIG. 4 that, according to a preferred embodiment of the invention, said fillets 36 are cross-sectionally triangular. The number of fillets 36 may be from two to six and they are intended to prevent the pulp in tower 10 from starting to rotate on the level of the second conical section 34 of parting member 31, as well as supporting the party member 31. FIG. 4 also indicates how mixer 40 is preferably disposed relative to bottom pillar 30 in bottom portion 20 of the tower.

Figure 5:
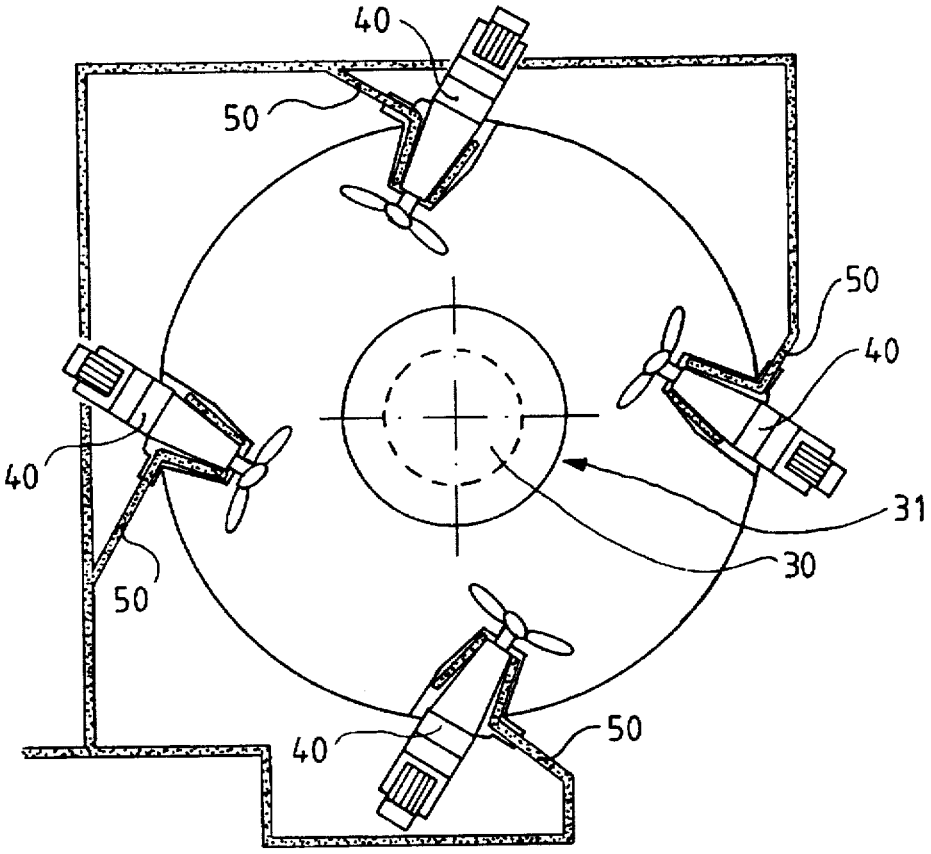
FIG. 5 illustrates an embodiment according to FIG. 4 seen from above.

FIG. 5 shows the bottom portion arrangement of the high consistency pulp tower of FIG. 3 seen from above. It can be seen that this embodiment contains four mixers 40 (the number of mixers may range from two to six, primarily depending on the tower size), each mixer 40 being connected with a feed conduit 50 for dilution liquid. Mixers 40 are disposed in bottom portion 20 of the tower so that they cause the pulp to be diluted to circulate quickly around bottom pillar 30.

Figure 6:
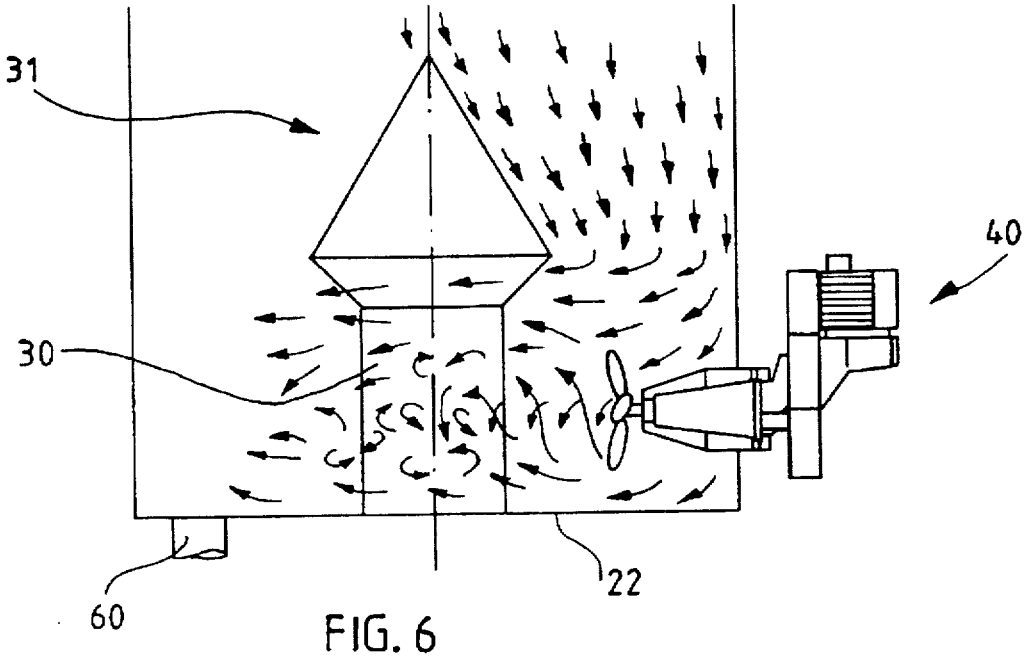
FIG. 6 shows a flow pattern developed by the mixers in the bottom portion of the high consistency pulp tower of FIG. 3.

FIG. 6 illustrates how bottom portion 20, i.e., a dilution zone, of a high consistency pulp tower in accordance with the invention operates in practice. For simplicity reasons, FIG. 6 illustrates only one mixer 40 and pulp being discharged from only one side of parting member 31 to the mixing zone of the lower part of the tower 10. The shape of parting member 31 according to the invention purposes to exactly mark off the mixing zone below the largest diameter of parting member 31 or, more extensively said, below the smallest cross-sectional area between parting member 31 and the wall of tower 10, so that the circulating flow provided by mixers 40 is prevented from rising to a level of parting member 31 which is higher than the upper end of pillar 30. In prior art constructions, rising of the flow to the upper end of the pillar and even slightly above it caused uncontrolled discharge of pulp from the upper part of the tower to the mixing zone. Another object of the invention is that mixers 40 bring about a ring-shaped circulation of pulp in the mixing zone of the tower, which ring-shaped circulation of pulp, by means of the great difference in both the flow rate and direction, then evenly "cuts" pulp from the slowly downwardly flowing high consistency pulp to the dilution zone.

Figure 1A:
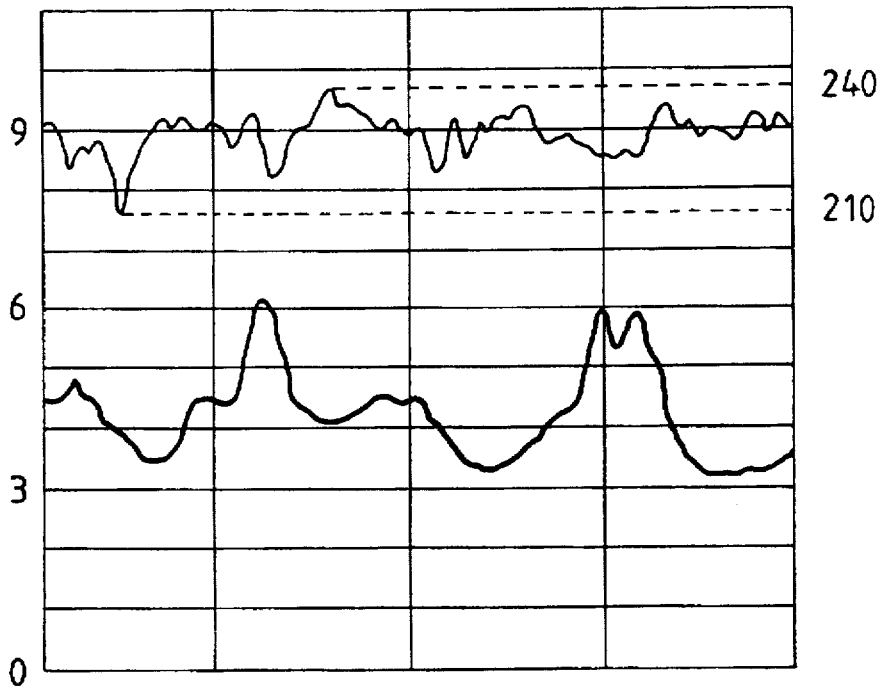
FIG. 1*a* illustrates the discharge flow and the discharge consistency of discharged pulp as functions of time when pulp is being discharged from a prior art, high consistency pulp tower.
Figure 1B:
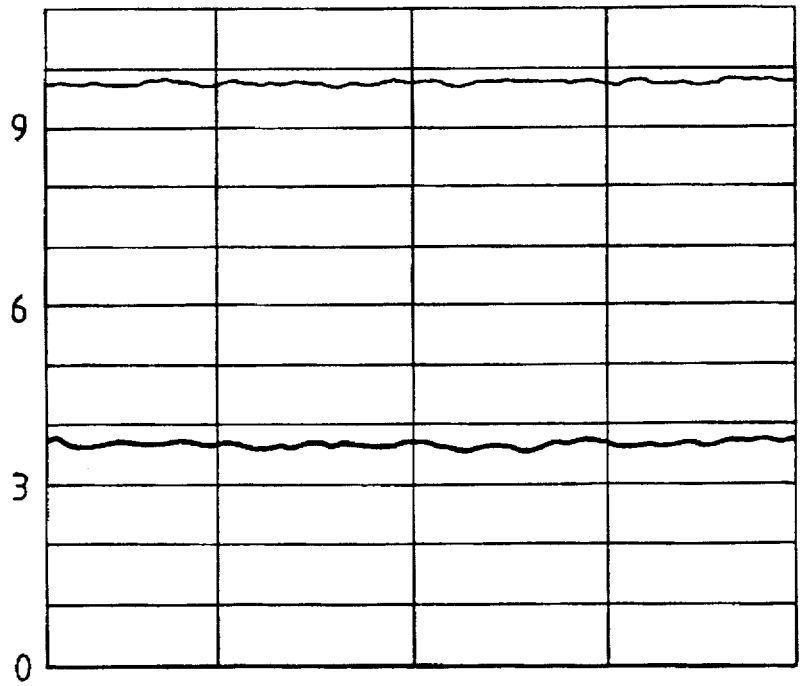
FIG. 1*b* illustrates pulp volume flows and discharge consistencies, provided by an improvement according to a preferred embodiment of the invention, as functions of time.

It can be concluded, when reviewing measuring results of FIG. 1b and comparing them with the results measured in the tower of FIG. 1a that the invention functions as it was intended to. In FIG. 1b, both the consistency and the volume flow of the discharge pulp are practically constant.

Figure 7:
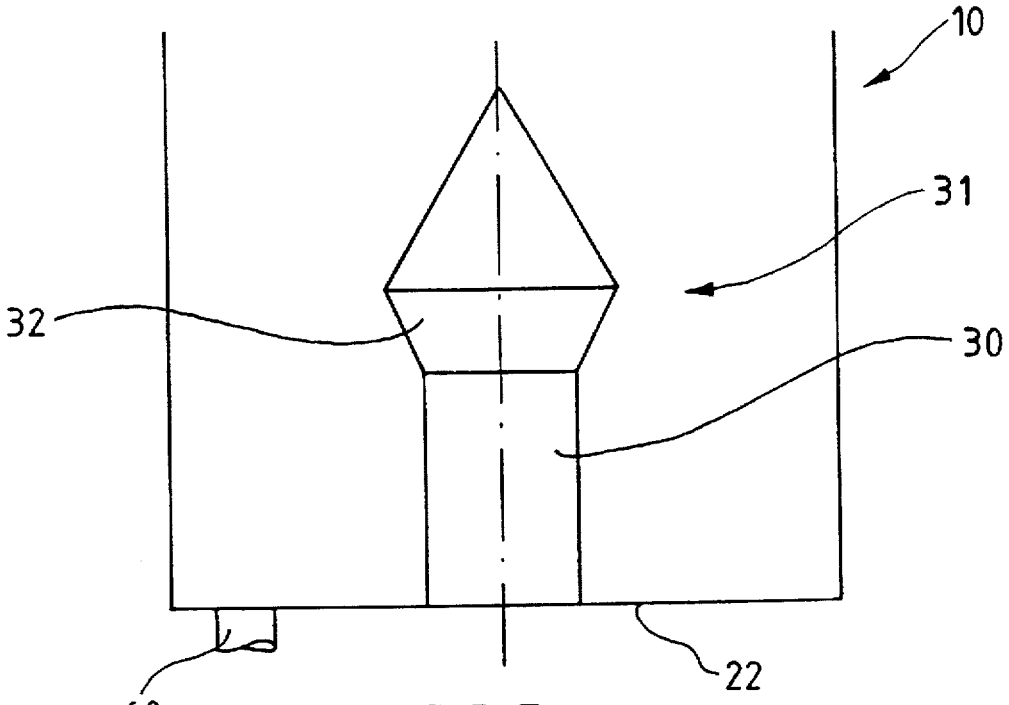
FIG. 7 illustrates the bottom portion of a high consistency pulp tower according to a third preferred embodiment of the invention.

FIG. 7 illustrates a bottom pillar 30 according to a third preferred embodiment and a parting member 31 disposed at the upper end of the pillar. The tip angle of the lower conical section 32 of parting member 31 has been decreased, whereby the length of the first conical section 32 has increased.

Figure 8:
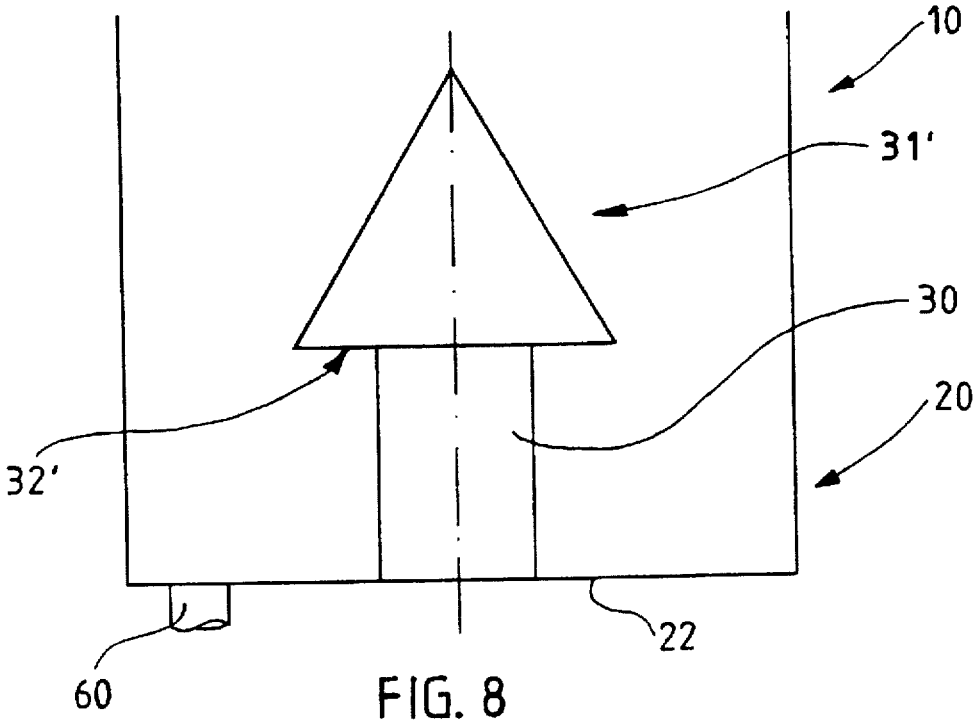
FIG. 8 illustrates the bottom portion of a high consistency pulp tower according to a fourth preferred embodiment of the invention.

FIG. 8 illustrates a bottom pillar 30 according to a fourth preferred embodiment and a parting member 31' disposed at the upper end of the pillar, where the first conical section of FIG. 3 has been replaced with a radial plate 32', which correspondingly limits the mixing zone to bottom portion 20 of tower 10.

Figure 9:
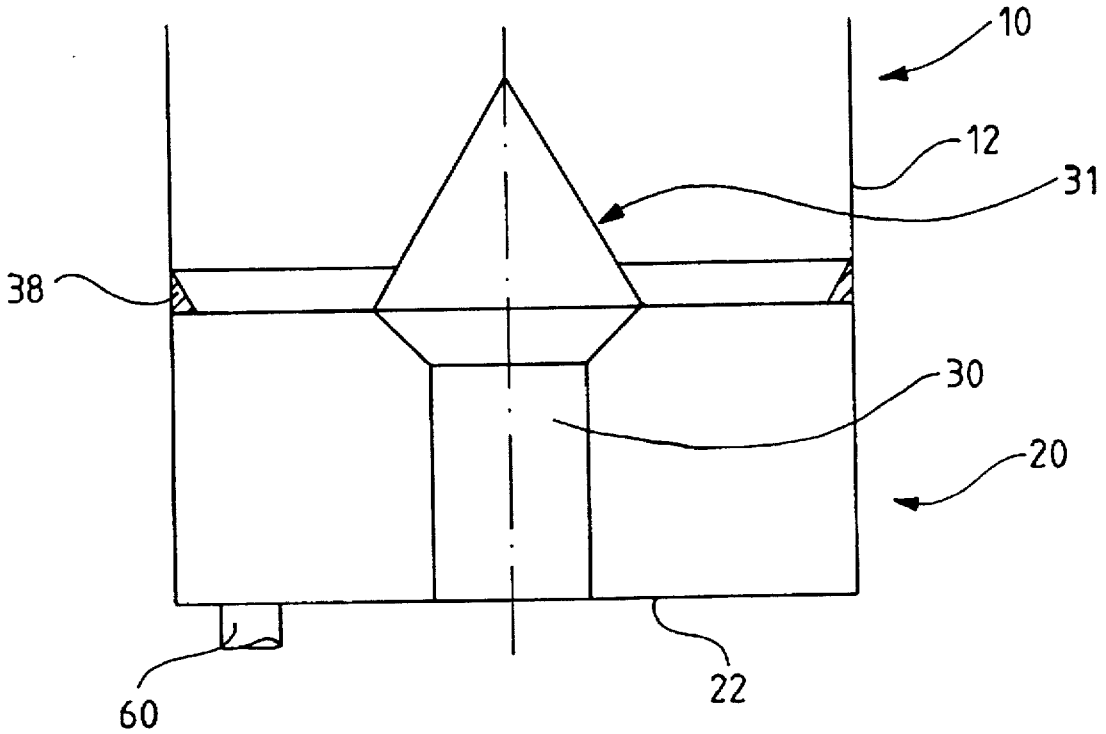
FIG. 9 illustrates the bottom portion of a high consistency pulp tower according to a fifth preferred embodiment of the invention.

FIG. 9 illustrates still another way of improving the function of both the bottom portion and the mixing/dilution zone arranged therein. On wall 12 of tower 10, essentially on the level of the largest diameter of parting member 31 is disposed an inwardly extending throttling/guide ring 38. Its task is also to limit the mixing/dilution zone and to prevent the circulating flow, brought about the mixers, from rising unnecessarily high up. The described guide ring 38 may naturally be also used alone without any parting member 31 at the upper end of bottom pillar 30, i.e., an extension of the upper end of the bottom pillar.

Figure 10:
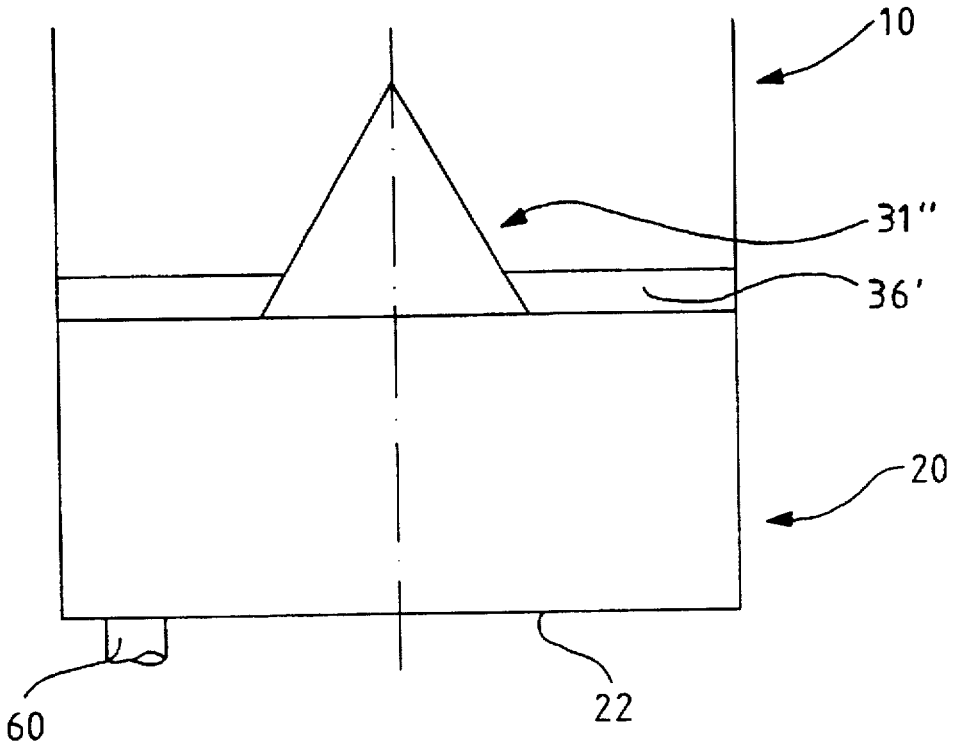
FIG. 10 illustrates the bottom portion of a high consistency pulp tower according to a sixth preferred embodiment of the invention.

FIG. 10 shows an arrangement which slightly deviates from the earlier described embodiments. In this arrangement, a parting member 31" is attached to the tower wall with arms 36', which may be used as fillets 36 of FIG. 4, to prevent the pulp from starting to circulate on the side of the parting member. The biggest difference between this and the above described embodiments is naturally that there is no bottom pillar in this embodiment, but the parting member is totally resting on arms 36'.

Figure 11:
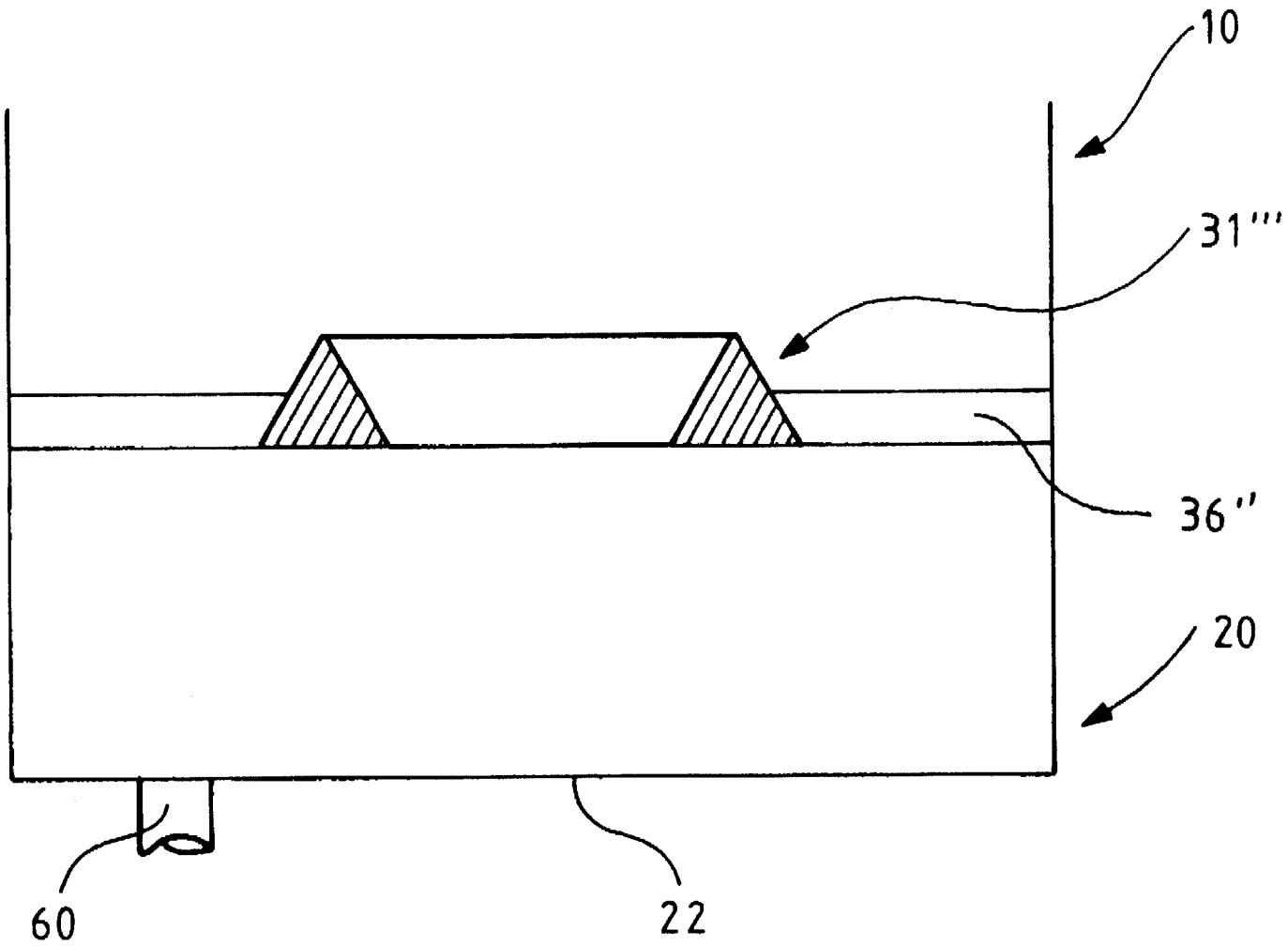
FIG. 11 illustrates the bottom portion of a high consistency pulp tower according to a seventh preferred embodiment of the invention.

FIG. 11 illustrates a still further embodiment where the arrangement of FIG. 10 has been further developed, for example, for towers having a still larger diameter. In the arrangement of FIG. 11, a parting member 31'" is also carried by the tower wall alone, through arms 36", but parting member 31'" comprises a ring, the cross section of which (an equilateral triangle with an upwardly facing apex) substantially corresponds to that of the parting member 31 described in the above embodiments.

EXAMPLE 1

In a practical test where an improvement in a high consistency pulp tower in accordance with the invention (disclosed in FIG. 3) was tested, the dimensions of the tower and the bottom pillar were as follows: tower diameter in the bottom portion 6000 mm, diameter of the lower section of bottom pillar 30 1400 mm, maximum diameter of the upper end of the bottom pillar 2400 mm, height of the cylindrical part of the bottom pillar 2100 mm, tip angle of the first conical surface at the upper end of the bottom pillar 90, and tip angle of the second conical surface 60. The elevation of the mixer shaft from the tower bottom was 950 mm, and the mixers used were similar to those disclosed in FI patent application 902486, in which the dilution liquid to be mixed is fed among the pulp from inside the jacket encasing the mixer shaft.

EXAMPLE 2

Tests with various extensions of the bottom pillar and guide/throttling rings attached to the tower wall revealed that the best results were gained when the area of the largest surface defined by the bottom pillar extension and being perpendicular to the axis of the tower was 2.5 to 3.2 times, preferably 2.8 times the cross-sectional area of the bottom pillar lower end. Defined in a different manner, a preferred construction is such that the ratio of the area between said extension and tower wall (or throttling/guide ting) to the area between the bottom pillar and tower wall is 0.5 to 0.95, preferably 0.90. It was also established that an advantageous construction was such that, in the area of the bottom pillar upper end the cross section between the tower wall (or throttling/guide ring) and the pillar was 50 to 95%, preferably 90% of the area between the bottom pillar lower end and the tower wall. Further, the most suitable tip angle of the cone or a piece of a like shape at the bottom pillar upper end proved to be 45 to 70 degrees, preferably 60 degrees; that is the parting member 31 sloping surface has an angle to the tower axis which is the complement of the above indicated angles, i.e. between about 20°–45°, preferably about 30°. This angular relationship (whether for a cone, pyramid, or the like) ensures that high consistency pulp flows evenly downwardly toward the dilution zone.

In an exemplary method according to the present invention, a first cross-sectional area is defined between the base of the cone 34 and the side wall 12 (see FIG. 4), this first cross-sectional area being at most 95% of (and typically about 90% or less of) the second cross-sectional flow area in the dilution zone below the base of the cone 34 (that is at the pillar 30). Cellulose pulp having a consistency of over 20% (e.g. about 20–35%) is caused to flow through the first cross-sectional area, past the base of the cone 34, into the dilution zone, and the pulp is diluted in the dilution zone so that it has a consistency of about 15% or less (from about 3–15%). The pulp is then discharged through the outlet 60 from the dilution zone of the tower 10. Flow past the cone 34, dilution of the pulp in the dilution zone, and discharge of the pulp through discharge 60 may be facilitated by one or more mixers 40 (e.g. between 2–6 mixers 40), and the dilution liquid may be introduced immediately adjacent at least one of the mixers 40.

It is also to be understood that all of the components as described above may have various other constructions. For example the pillar 30 may have a wide variety of different constructions, and may be cylindrical in shape, a rectangular parallelepiped, either solid or hollow, and in fact may even itself have a tapered configuration (e.g. the shape of a cone frustum or pyramid frustum).

It will thus be seen that according to the present invention a novel and advantageous high consistency pulp tower and method of discharging pulp from a tower have been provided, such advantages being indicated by the practical test results shown in FIG. 1*b*, so that the discharge of pulp from high consistency pulp towers takes place at a substantially even volume flow and substantially steady pulp consistency. While the invention has been herein shown and described in what is presently conceived to be the most practical and preferred embodiments thereof it will be apparent to those of ordinary skill in the art that many modifications may be made thereof within the scope of the invention, which scope is to be accorded the broadest interpretation of the appended claims so as to encompass all equivalent structures and methods.

What is claimed is:

1. A high consistency pulp tower comprising:

a tower having a side wall, bottom, generally vertical axis, and bottom portion above said bottom;

means for diluting high consistency pulp in said bottom portion, defining a dilution zone;

pulp discharge means from said dilution zone;

a parting member comprising a cone, cone frustum, pyramid, or pyramid frustum, extending upwardly from its base, disposed in said bottom portion above said diluting means and pulp discharge means, said parting member constructed so as to define a first cross-sectional flow area between said parting member and said side wall which is smaller than a second cross-sectional flow area below said parting member, in said dilution zone; and a pillar disposed in said bottom portion, said pillar having a lower end supported at least in part by said tower bottom, and said pillar having an upper end connected to said parting member, said pillar at least in part supporting said parting member; and wherein the ratio of the area between said base of said cone, cone frustum, pyramid, or pyramid frustum and said side wall, to the area between said lower end of said pillar and said side wall, is between 0.5–0.95.

2. A pulp tower as recited in claim 1 wherein said parting member is disposed substantially concentrically with said tower axis.

3. A pulp tower as recited in claim 2 wherein said parting member is an extension of said upper end of said pillar.

4. A pulp tower as recited in claim 3 further comprising a ring extending inwardly from said side wall toward said parting member and defining said first cross-sectional flow area with said parting member.

5. A pulp tower as recited in claim 3 further comprising a plurality of arms extending from said side wall toward said parting member and cooperating with said pillar to support said parting member.

6. A pulp tower as recited in claim 2 wherein said parting member comprises a cone having a base and extending upwardly from said base, and a cone frustum having said base in common with said cone, and extending downwardly to said pillar.

7. A pulp tower as recited in claim 2 wherein the area of said base of said cone, cone frustum, pyramid, or pyramid frustum, substantially perpendicular to the axis of said tower, is between 2.5–3.2 times the cross-sectional area of the lower end of said pillar.

8. A pulp tower as recited in claim 2 wherein said first cross-sectional flow area is between about 50–95% of said second cross-sectional flow area at said lower end of said pillar.

9. A pulp tower as recited in claim 2 wherein said parting member comprises a ring having a substantially triangular cross-section with an upwardly pointing apex, said ring spaced from said side wall and substantially concentric with said tower axis.

10. A pulp tower as recited in claim 2 further comprising a ring extending inwardly from said side wall toward said parting member and defining said first cross-sectional flow area with said parting member.

11. A pulp tower as recited in claim 1 further comprising a plurality of arms extending from said side wall toward said parting member and at least in part supporting said parting member.

12. A pulp tower as recited in claim 1 wherein said parting member has an angle to said tower axis of between 20–45 degrees.

13. A pulp tower as recited in claim 1 further comprising a plurality of arms extending from said side wall toward said parting member and cooperating with said pillar to support said parting member.

14. A pulp tower as recited in claim 1 further comprising a ring extending inwardly from said side wall toward said parting member and defining said first cross-sectional flow area with said parting member.

15. A pulp tower as recited claim 14 wherein said triangular in cross-section.

16. A pulp tower as recited in claim 1 further comprising at least two mixers positioned at said bottom portion below said parting member.

17. A pulp tower as recited in claim 16 wherein between two to six mixers are provided in the dilution zone, and wherein said means for diluting high consistency pulp comprises means for introducing dilution liquid immediately adjacent at least one of the mixers.

18. A pulp tower as recited in claim 17 wherein said dilution liquid introducing means is structurally combined with each of said mixers.

19. A pulp tower as recited in claim 1 further comprising a plurality of arms extending from said side wall toward said parting member and cooperating with said pillar to support said parting member.

20. A pulp tower as recited in claim 1 wherein the area of said base of said cone, cone frustum, pyramid, or pyramid frustum, substantially perpendicular to the axis of said tower, is between 2.5–3.2 times the cross-sectional area of the lower end of said pillar.

21. A pulp tower as recited in claim 1 wherein said parting member comprises a cone having a base and extending upwardly from said base, and a cone frustum having said base in common with said cone, and extending downwardly to said pillar.

22. A pulp tower comprising:

a tower having a side wall, bottom, generally vertical axis, and bottom portion above said bottom;

a parting member disposed in said bottom portion substantially concentric with said tower axis, said parting member comprising a cone, cone frustum, pyramid, or pyramid frustum, extending upwardly from its base constructed so as to define a first cross-sectional flow area between said parting member base and said side wall which is at most 95% of a second cross-sectional flow area below said parting member base;

a pillar disposed in said bottom portion, said pillar having a lower end supported at least in part by said tower bottom, and said pillar having an upper end connected to said parting member, said pillar at least in part supporting said parting member;

wherein said parting member is an extension of said upper end of said pillar; and a ring extending inwardly from said side wall toward said parting member and defining said first cross-sectional flow area with said parting member.

23. A pulp tower as recited in claim 22 wherein the ratio of the area between said base of said cone, cone frustum, pyramid, or pyramid frustum and said side wall, to the area between said lower end of said pillar and said side wall, is between 0.5–0.95.

24. A pulp tower as recited in claim 22 further comprising a plurality of arms extending from said side wall toward said parting member and cooperating with said pillar to support said parting member.

25. A pulp tower as recited in claim 22 wherein the area of said base of said cone, cone frustum, pyramid, or pyramid frustum, substantially perpendicular to the axis of said tower, is between 2.5–3.2 times the cross-sectional area of the lower end of said pillar.

26. A pulp tower as recited in claim 22 wherein said parting member comprises a cone having a base and extending upwardly from said base, and a cone frustum having said base in common with said cone, and extending downwardly to said pillar.

27. A method of diluting and discharging cellulose pulp having a consistency of over 20% from a tower having a side wall, bottom, generally vertical axis, and bottom portion with dilution zone above the bottom, said method comprising the steps of:

(a) defining a first cross-sectional area in the bottom portion above the dilution zone which is at most 95% of a second cross-sectional flow area in the dilution zone;

(b) causing cellulose pulp having a consistency of over 20% to flow through the first cross-sectional area to the dilution zone;

(c) diluting the cellulose pulp in the dilution zone so that it has a consistency of about 15% or less; and (d) discharging the diluted cellulose pulp from the dilution zone of the tower at a substantially even volume flow and a substantially steady pulp consistency.

28. A method as recited in claim 27 wherein steps (b)–(d) are practiced, at least in part, by disposing between two to six mixers in the dilution zone, and introducing dilution liquid immediately adjacent at least one of the mixers.

29. A method as recited in claim 27 wherein step (b) is practiced by causing pulp having a consistency of about 20–35% to flow through the first cross-sectional area, and wherein step (c) is practiced to dilute the cellulose pulp to a consistency of about 3–15%.

30. A high consistency pulp tower comprising:

a tower having a side wall, bottom, generally vertical axis, and bottom portion above said bottom;

means for diluting high consistency pulp in said bottom portion, defining a dilution zone;

pulp discharge means from said dilution zone;

a parting member disposed in said bottom portion above said diluting means and pulp discharge means, said parting member constructed so as to define a first cross-sectional flow area between said parting member and said side wall which is smaller than a second cross-sectional flow area below said parting member, in said dilution zone;

between two to six mixers positioned at said bottom portion below said parting member;

said diluting means comprising means for introducing diluting liquid at said bottom portion of said tower immediately adjacent at least one of said mixers so that said mixers mix the dilution liquid with pulp as the pulp is caused to rotate along an annular path; and wherein said parting member comprises a cone, cone frustum, pyramid, or pyramid frustum, extending upwardly from its base; and connected to a pillar having a lower end and wherein the ratio of the area between said base of said cone, cone frustum, pyramid, or pyramid frustum and said side wall, to the area between said lower end of said pillar and said side wall is between 0.5–0.95.

31. A pulp tower as recited in claim 30 wherein said diluting liquid introducing means is structurally combined with each of said mixers.

32. A pulp tower as recited in claim 30 further comprising a ring extending inwardly from said side wall toward said parting member and defining said first cross-sectional flow area with said parting member.

33. A pulp tower as recited in claim 30 further comprising a plurality of arms extending from said side wall toward said parting member and cooperating with said pillar to support said parting member.

34. A high consistency pulp tower comprising:

a tower having a side wall, bottom, generally vertical axis, and bottom portion above said bottom;

means for diluting high consistency pulp in said bottom portion, defining a dilution zone;

pulp discharge means from said dilution zone;

a parting member comprising a cone, cone frustum, pyramid, or pyramid frustum, extending upwardly from its base, disposed in said bottom portion above said diluting means and pulp discharge means, said parting member constructed so as to define a first cross-sectional flow area between said parting member and said side wall which is smaller than a second cross-sectional flow area below said parting member, in said dilution zone; and a pillar disposed in said bottom portion, said pillar having a lower end supported at least in part by said tower bottom, and said pillar having an upper end connected to said parting member, said pillar at least in part supporting said parting member; and wherein the area of said base of said cone, cone frustum, pyramid, or pyramid frustum, substantially perpendicular to the axis of said tower, is between 2.5–3.2 times the cross-sectional area of the lower end of said pillar.

* * * * *